United States Patent [19]

Layman

[11] Patent Number: 4,752,267

[45] Date of Patent: Jun. 21, 1988

[54] DOUBLE FLYING DISC

[76] Inventor: Robert Layman, 514 Goshen Ave., Elkhart, Ind. 46516

[21] Appl. No.: 55,551

[22] Filed: May 29, 1987

[51] Int. Cl.[4] ..... A63H 27/00

[52] U.S. Cl. ..... 446/46; D21/86

[58] Field of Search ..... 446/46, 47, 48; 273/424, 425, 428; D21/85, 86

[56] References Cited

U.S. PATENT DOCUMENTS

| | | | |
|---|---|---|---|
| 3,113,396 | 12/1963 | Collins | 446/46 |
| 3,407,514 | 10/1968 | Christian | 446/69 X |
| 3,758,985 | 9/1973 | Heisler | 446/46 |
| 4,117,626 | 10/1978 | Kifferstein | 446/47 |

*Primary Examiner*—Mickey Yu

*Attorney, Agent, or Firm*—H. Jay Spiegel

[57] ABSTRACT

The present invention relates to an improved double flying disc including two discs attached together in vertically stacked relation by a plurality of collapsible rings. The device is thrown with the discs adjacent one another and, during flight, the discs separate from one another as the connecting rings allow such separation until the rings are opened as far as they can open due to their interactions with one another. After the double flying disc lands, the rings collapse, allowing the discs to be adjacent one another and ready for the next throw.

3 Claims, 1 Drawing Sheet

DOUBLE FLYING DISC

BACKGROUND OF THE INVENTION

In the prior art, projectiles are known which incorporate a plurality of discs mounted together. U.S. Pat. No. 2,025,484 discloses a game wherein discs 30 and 31 are connected together with a coil spring 34 and wherein the device is designed to jump across the playing surface. U.S. Pat. No. 4,182,073 to Tabet discloses a twin flying saucer toy wherein two flying discs are rigidly fixed together through the provision of pins 15.

U.S. Pat. No. 4,246,720 to Stone discloses a device designed to be attached to a flying disc and including a plurality of vanes 26 circumferentially spaced from one another and which make noise when the disc is thrown. Finally, U.S. Pat. No. 4,288,942 to Nicholl discloses an aerodynamic device including a first disc 2 having a second disc mounted thereto and designated by the reference numeral 5. The discs 2 and 5 are designed to be fixedly secured to one another without movement therebetween.

None of the prior art known to applicant as set forth above includes a pair of discs mounted together for movement away from and toward one another during and after flight. As such, the present invention is believed to patentably distinguish from these references.

SUMMARY OF THE INVENTION

The present invention overcomes the deficiencies in the prior art set forth above and provides a new, improved double flying disc with great aesthetic and functional advantage over the prior art. The present invention includes the following interrelated features and aspects:

(a) In a first aspect of the present invention, the inventive double flying disc includes two flying discs such as those manufactured and sold under the trademark Frisbee TM and including a convex shape with a hollow undersurface.

(b) The two discs are oriented with respect to one another with the convex surface of the lower disc facing the undersurface of the upper disc.

(c) The two discs are interconnected with one another by virtue of a plurality of rings which gradually increase in diameter from one disc to the other and are so designed that they may collapse upon one another so that the discs may lie flat adjacent to one another only separated by the thickness of a single ring.

(d) When it is desired to throw the improved double flying disc, with the two discs adjacent one another and only separated by the thickness of one ring, the double flying disc is thrown and, during flight, the rings allow separation of the two discs from one another to an extent until the structure of the rings causes them to wedge against one another to thereby define the extent of maximum separation of the discs. When the double flying disc lands or is caught, the rings may collapse allowing the discs to become adjacent to one another only separated by the thickness of a single ring. Depending upon the ring thickness, since the rings are attached with one end ring attached to the convex surface of the lower disc and the other end ring attached within the undersurface of the upper disc, it is possible that when the rings are collapsed, the discs may engage one another.

(e) One of the advantages of the present invention is the fact that with the discs adjacent one another the device may be easily thrown and during flight the separation of the discs causes the device to attain the stability disclosed in U.S. Pat. No. 4,182,073 to Tabet. The advantage over Tabet is that in Tabet the discs are fixedly secured at a predetermined separation from one another thereby making it more difficult to throw the Tabet device. Since the present invention in its collapsed state has its discs immediately adjacent one another, it is much easier to throw the double flying disc of the present invention than it is to throw the Tabet device.

Accordingly, it is a first object of the present invention to provide an improved double flying disc having a plurality of discs attached together.

It is a further object of the present invention to provide such an improved double flying disc wherein the connection between the discs is collapsible so that the device may be thrown with the discs adjacent one another and whereupon during flight the discs may separate to a predetermined degree.

It is a still further object of the present invention to provide an improved double flying disc wherein when the device is caught or lands, the interconnecting rings may collapse upon one another thereby allowing the discs to lie adjacent one another.

These and other objects, aspects and features of the present invention will be better understood from the following detailed description of the preferred embodiment when read in conjunction with the appended drawing figures.

SPECIFIC DESCRIPTION OF THE PREFFERED EMBODIMENTS

Figure 1:
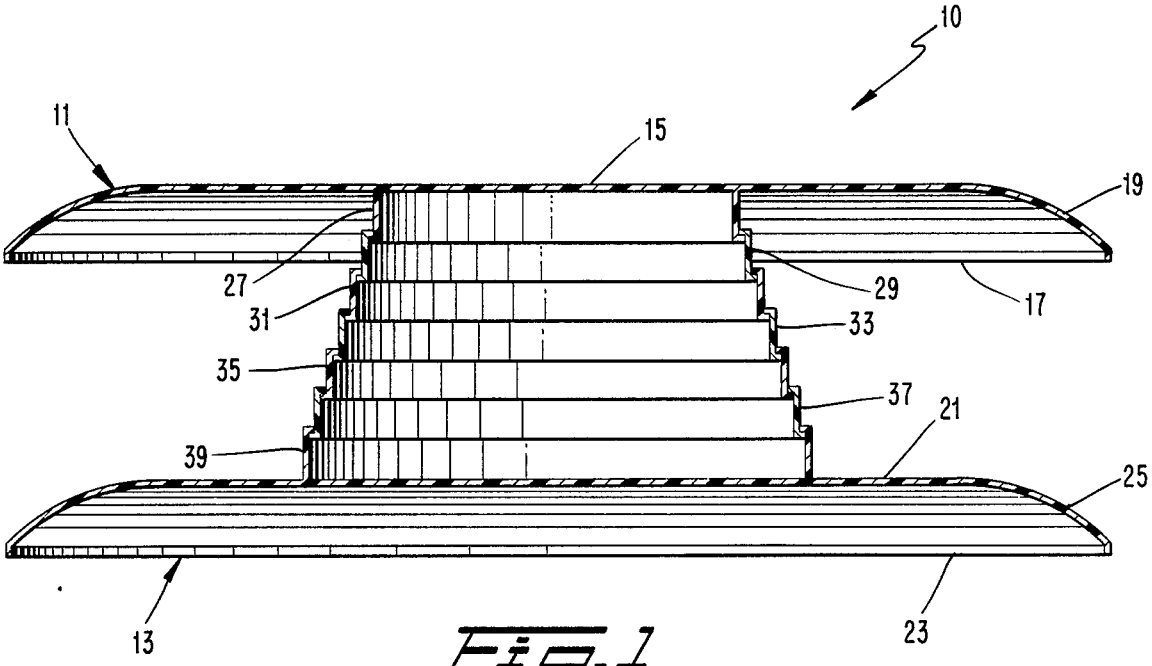
FIG. 1 shows a cross-sectional view through the present invention with the rings thereof in expanded configuration.

Reference is first made to FIG. 1 which shows the inventive device 10 to include a first disc 11 and a second disc 13. The first disc 11 includes a convex upper surface 15, a concave undersurface 17 and a curved rim 19. Correspondingly, the disc 13 includes a convex upper surface 21, a concave undersurface 23 and a curved rim 25.

Figure 2:
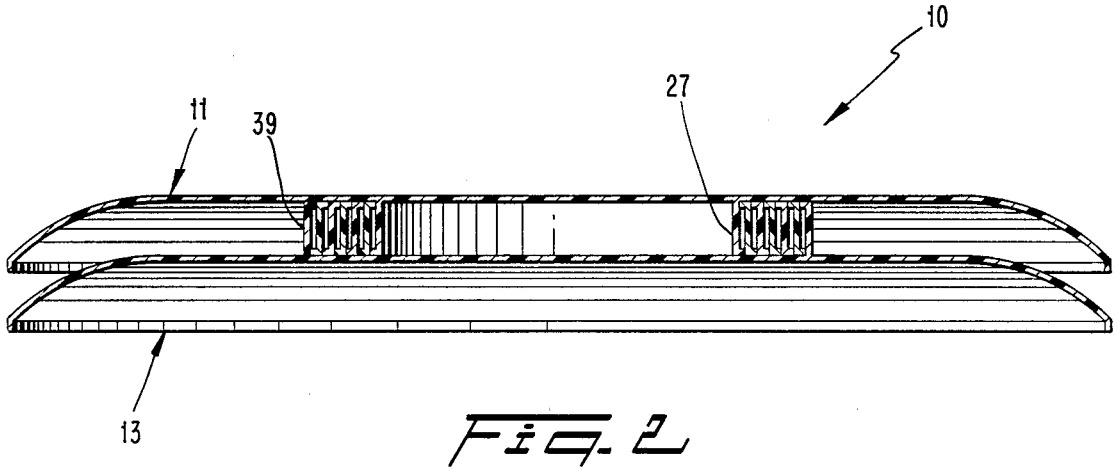
FIG. 2 shows a cross-sectional view of the present invention with the rings thereof in collapsed configuration.

As best seen in FIG. 1, the discs 11 and 13 are interconnected by virtue of a plurality of concentric rings 27, 29, 31, 33, 35, 37 and 39. As best seen in the cross-sectional view of FIG. 1, each of the rings 27–39 has a truncated, conical configuration with the larger diameter portion thereof being slightly larger in diameter than the smaller diameter portion of the next ring. The rings are assembled with the ring 37 being passed through the ring 39 from below, the ring 35 being passed through the ring 37 from below, the ring 33 being passed through the ring 35 from below, the ring 31 being passed through the ring 33 from below, the ring 29 being passed through the ring 31 from below and the ring 27 being passed through the ring 29 from below. In this way, as the rings are extended to the configuration shown in FIG. 1, a wedging effect occurs between each adjacent ring which prevents separation of the rings while extending the spacing between the discs 11 and 13. With reference to FIG. 2, when the discs 11 and 13 are collapsed adjacent one another, the rings 27–39 lie in concentric relation to one another in a lose manner allowing the discs 11 and 13 to lie adjacent one another.

In the position of the discs 11 and 13 shown in FIG. 2, the discs are grasped by the user and are thrown in the manner in which one such disc is normally thrown as is understood by those skilled in the art. When the discs are so thrown, the air pressure which builds up between the discs causes them to separate until such time as they attain the configuration seen in FIG. 1, whereupon they continue to travel to their destination based upon how much energy has been imparted to them by the thrower. In the position shown in FIG. 1, since two discs are used, enhanced lift is attained due to the additional lifting area and since the lifting area consists of two wings stacked upon one another, great stability accrues such as that which is attained in a biplane.

In the preferred embodiment of the present invention, the ring 27 is attached to the concave undersurface 17 of the disc 11 by any desired means such as, for example, strong adhesive. Similarly, the ring 39 is attached to the convex surface 21 of the disc 13 by any suitable means such as, for example, adhesive.

Of course, many changes, alterations and modifications in the teachings of the present invention may be contemplated by those skilled in the art without departing from the intended spirit and scope thereof. Accordingly, it is stressed that it is intended that the present invention only be limited by the terms of the appended claims.

I claim:

1. An improved double flying disc comprising:

(a) a first disc having a convex upper surface and a concave undersurface;

(b) a second disc having a convex upper surface and a concave undersurface; and (c) connection means connecting said first disc undersurface to said second disc upper surface, said connection means allowing relative movement of said discs with respect to one another, said connection means comprising a telescoping device allowing said discs to move toward and away from one another.

2. The invention of claim 1, wherein said telescoping device comprises a plurality of rings of successively increasing dimensions each said ring having a truncated conical cross-section, said rings being expandable as a group without separating.

3. The invention of claim 2, wherein said plurality of rings comprises at least three rings, a first ring attached at its smallest diameter to said first disc undersurface, a second ring attached at its largest diameter to said second disc upper surface and a third ring having a smallest diameter smaller than the largest diameter of said first ring, and having a largest diameter larger than the smallest diameter of said second ring.

* * * * *